US008781346B2

(12) United States Patent
Odani

(10) Patent No.: US 8,781,346 B2
(45) Date of Patent: Jul. 15, 2014

(54) IMAGE FORMING APPARATUS AND METHOD

(75) Inventor: Makoto Odani, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 369 days.

(21) Appl. No.: 13/167,669

(22) Filed: Jun. 23, 2011

(65) Prior Publication Data

US 2012/0002987 A1 Jan. 5, 2012

Related U.S. Application Data

(60) Provisional application No. 61/360,461, filed on Jun. 30, 2010.

(51) Int. Cl.
*G03G 21/18* (2006.01)

(52) U.S. Cl.
CPC ..... *G03G 21/1889* (2013.01)
USPC ..... 399/44; 399/50; 399/51; 399/67; 399/94

(58) Field of Classification Search
CPC ..... G03G 21/1889
USPC ..... 399/11, 24, 25, 44, 46, 50, 51, 53, 67, 399/94
See application file for complete search history.

(56) References Cited

U.S. PATENT DOCUMENTS

| | | | | |
|---|---|---|---|---|
| 5,926,666 | A * | 7/1999 | Miura et al. | 399/25 |
| 2002/0041767 | A1* | 4/2002 | Saito et al. | 399/44 |
| 2004/0141761 | A1* | 7/2004 | Ikegawa | 399/1 |
| 2008/0181674 | A1* | 7/2008 | Kaiho | 399/262 |
| 2008/0187854 | A1* | 8/2008 | Yoshida et al. | 430/109.4 |
| 2009/0110440 | A1* | 4/2009 | Homma et al. | 399/262 |

FOREIGN PATENT DOCUMENTS

| | | |
|---|---|---|
| JP | 10-010955 | 1/1998 |
| JP | 2003-295708 | 10/2003 |
| JP | 2006-163143 | 6/2006 |

* cited by examiner

*Primary Examiner* — Walter L Lindsay, Jr.
*Assistant Examiner* — Jessica L Eley
(74) *Attorney, Agent, or Firm* — Patterson & Sheridan, LLP

(57) ABSTRACT

Certain embodiments provide an image forming apparatus including: an image carrier; a latent image forming unit; a developing unit; a fixing unit; a toner cartridge; a battery in the toner cartridge; a temperature sensor in the toner cartridge driven by the battery; a first controller which causes the temperature sensor to measure an ambient temperature periodically in the toner cartridge and be supplied with power from the battery; a recording medium which is provided in the toner cartridge and records a result of measurement by the temperature sensor in timing controlled by the first controller; and a second controller which reads out information recorded in the recording medium, and changes an operating condition of the latent image forming unit, the developing unit and the fixing unit according to a state of preservation of the supply of toner, based on the information.

20 Claims, 8 Drawing Sheets

FIG.5

60

| MEASURED TEMPERATURE (°C) | COUNTER NAME | COUNTER VALUE (NUMBER OF TIMES) |
|---|---|---|
| OVER 75 | M75(OVER 75) | 0 |
| 70 TO 75 | M70 | 0 |
| 65 TO 70 | M65 | 0 |
| 60 TO 65 | M60 | 0 |
| 55 TO 60 | M55 | 0 |
| 50 TO 55 | M50 | 0 |
| 45 TO 50 | M45 | 0 |
| 40 TO 45 | M40 | 0 |
| 35 TO 40 | M35 | 0 |
| 30 TO 35 | M30 | 300 |
| 25 TO 30 | M25 | 2000 |
| 20 TO 25 | NONE | NOT COUNTED |
| 15 TO 20 | NONE | NOT COUNTED |
| 10 TO 15 | NONE | NOT COUNTED |
| 5 TO 10 | NONE | NOT COUNTED |
| 0 TO 5 | M0 | 200 |
| −5 TO 0 | M(−5) | 0 |
| −10 TO −5 | M(−10) | 0 |
| UNDER −10 | M(UNDER −10) | 0 |

FIG.7

62

| STORAGE TEMPERA-TURE (°C) | COUNTER VALUE (MAX) | EXPIRY DATE | STIRRING TIME (SEC) | DEVELOPMENT, TRANSFER BIAS, FIXING TEMPERATURE |
|---|---|---|---|---|
| OVER 75 | 1 | UNUSABLE | | |
| 70 TO 75 | 6 | UNUSABLE | | |
| 65 TO 70 | 12 | UNUSABLE | | |
| 60 TO 65 | 36 | UNUSABLE | | |
| 55 TO 60 | 144 | 3 MONTHS | 180 | SETTING 3 |
| 50 TO 55 | 288 | 6 MONTHS | 150 | SETTING 3 |
| 45 TO 50 | 1008 | 1 YEAR | 120 | SETTING 3 |
| 40 TO 45 | 8048 | 2 YEARS | 90 | SETTING 2 |
| 35 TO 40 | 17280 | 2 YEARS | 60 | SETTING 2 |
| 30 TO 35 | 17280 | 2.5 YEARS | 30 | SETTING 1 |
| 25 TO 30 | 51840 | 2.5 YEARS | 10 | SETTING 1 |
| | | | | |
| 0 TO 5 | 6048 | 2 YEARS | 90 | SETTING 4 |
| -5 TO 0 | 1008 | 1 YEAR | 180 | SETTING 5 |
| -10 TO -5 | 1 | 3 MONTHS | 180 | SETTING 6 |
| UNDER -10 | 1 | UNUSABLE | | |

IMAGE FORMING APPARATUS AND METHOD

CROSS-REFERENCE TO RELATED APPLICATION

The present application claims priority under 35 U.S.C. 119 to U.S. Provisional Application Ser. No. 61/360,461, to Odani, filed on Jun. 30, 2010, the entire disclosure of which is incorporated herein by reference.

FIELD

Embodiments described herein relate generally to an image forming apparatus, a toner cartridge and an image forming method.

BACKGROUND

A toner cartridge has toner enclosed therein and is shipped from a factory. The toner cartridge is transported, stored, and finally loaded in an image forming apparatus.

The toner cartridge may be exposed to high temperatures during transportation and storage. As the toner cartridge is placed in a high-temperature environment for a long period of time, the toner hardens. The image forming apparatus cannot form a high-quality image.

In a related art, a toner cartridge having a recording medium such as a RFID (radio frequency identification) or an IC (integrated circuit) tag is known.

In the related art, a method is known in which at a warehouse where the cartridge is stored or at a base in the course of transportation, a writing device writes ambient temperatures in the warehouse or vehicle into the recording medium. A method is known in which a temperature detecting sticker is attached to the toner cartridge to learn that the toner cartridge is exposed to an environment in high temperatures at least once.

However, there is no method for detecting what condition the toner is preserved in. For example, the degree of temperature when the toner cartridge is stored cannot be grasped.

BRIEF DESCRIPTION OF THE DRAWINGS

FIG. 5 is a diagram showing an exemplary table in a recording medium used in the image forming apparatus;

FIG. 7 is a diagram showing an exemplary parameter change table used in the image forming apparatus.

DETAILED DESCRIPTION

Figure 1:
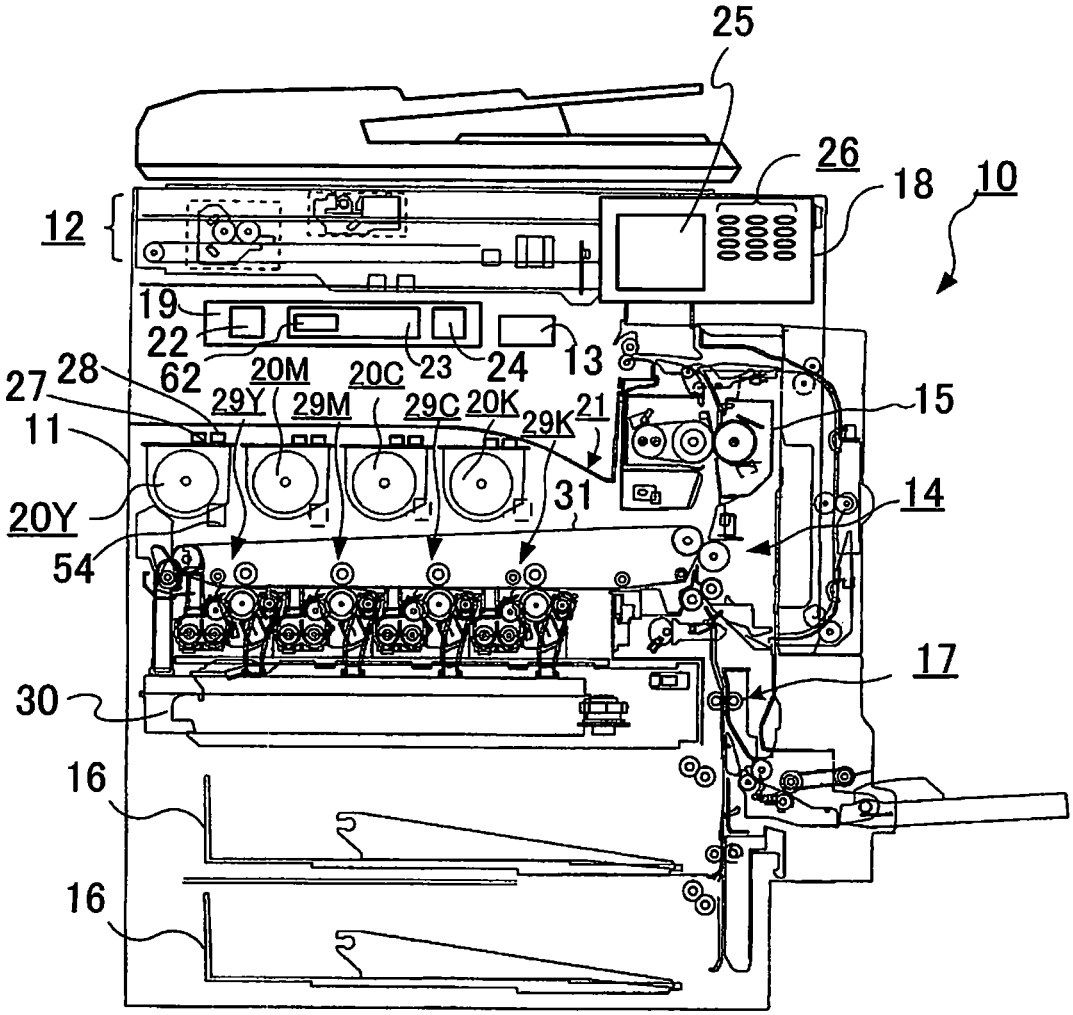
FIG. 1 shows the configuration of an image forming apparatus according to an embodiment.

Certain embodiments provide an image forming apparatus including: an image carrier in a body; a latent image forming unit configured to form an electrostatic latent image on the image carrier; a developing unit configured to develop the electrostatic latent image with a two-component developer containing toner particles and carrier particles; a fixing unit configured to fix, on a sheet, a toner image visualized on the image carrier by the developing unit; a toner cartridge configured to accommodate a supply of toner for the developing unit; a battery provided in the toner cartridge; a temperature sensor provided in the toner cartridge driven by the battery; a first controller configured to cause the temperature sensor to measure an ambient temperature periodically in the toner cartridge and be supplied with power from the battery; a recording medium provided in the toner cartridge and configured to record a result of measurement by the temperature sensor in timing controlled by the first controller; and a second controller configured to control execution of an image forming process in the body, read out information recorded in the recording medium, and change an operating condition of the latent image forming unit, the developing unit and the fixing unit according to a state of preservation of the supply of toner, based on the information.

Hereinafter, an image forming apparatus, a toner cartridge and an image forming method will be described in detail with reference to the attached drawings. The same parts in the drawings are denoted by the same reference numerals and no duplicate description of these parts is given.

An image forming apparatus according to an embodiment is an MFP (multi-function peripheral) using four color toners. A toner cartridge according to the embodiment is a toner supply device of one color which periodically records ambient temperatures.

Ambient temperatures refer to temperatures of air in the periphery of the toner cartridge.

An image forming method according to the embodiment includes recording ambient temperatures periodically after the toner cartridge is manufactured, and changing parameters for image formation in the MFP based on the ambient temperature information. Parameters refer to plural types of numeric values for changing image forming conditions.

FIG. 1 is a front view of the MFP.

The MFP 10 has a machine body 11 (body), a scanner unit 12, an image processing unit 13, a print process unit 14, a fixing unit 15, a paper supply unit 16, a carrying mechanism 17, an operation panel 18, and a main controller 19 (second controller).

The MFP 10 has a toner cartridge 20Y for yellow (Y), a toner cartridge 20M for magenta (M), a toner cartridge 20C for cyan (C), and a toner cartridge 20K for black (K).

The scanner unit 12 optically scans a document face. The scanner unit 12 outputs image data based on an image signal that is read. The image processing unit 13 corrects the image data.

The print process unit 14 forms an image on a sheet and outputs the sheet. The fixing unit 15 fixes the image that is not fixed yet, onto the sheet. The paper supply unit 16 supplies the sheet to the carrying mechanism 17.

The carrying mechanism 17 sends one sheet to the print process unit 14. The carrying mechanism 17 discharges the sheet from the fixing unit 15 to a tray 21.

The operation panel 18 has a display 25 and a user interface 26. The display 25 displays the toner expiry dates and the toner empty states in the toner cartridges 20Y, 20M, 20C and 20K. The user interface unit 26 has plural keys for a user to input information.

The main controller 19 is a second controller and controls operation of the whole MFP 10.

The main controller 19 controls execution of an image forming process in the machine body 11. The main controller 19 reads out information recorded in a memory 56. The main controller 19 changes operating conditions of a laser exposure unit 30, a charger 33, a developing unit 34 and the fixing unit 15 according to the state of preservation of a supply of toner, based on the information.

The main controller 19 has a CPU (central processing unit) 22, a ROM (read only memory) 23, and a RAM (random access memory) 24.

The ROM 23 holds plural parameter value groups, each one parameter value group including plural kinds of parameters. One parameter value group refers to an array of numeric values, for example, laser beam output power of 1 mW, grid bias potential of −500 V, primary transfer bias voltage of +1100 V, and fixing temperature of 110° C.

The ROM 23 generates a parameter change table 62 in advance. Alternatively, the RAM 24 generates the parameter change table 62 in advance. The parameter change table 62 holds, for example, six parameter value groups (setting 1, setting 2, setting 3, setting 4, setting 5, and setting 6), each including an array of numeric values.

The toner cartridge 20Y is a yellow toner supply device. The toner cartridge 20Y has a battery 27 and a circuit board 28.

The battery 27 supplies power to the circuit board 28.

Figure 4:
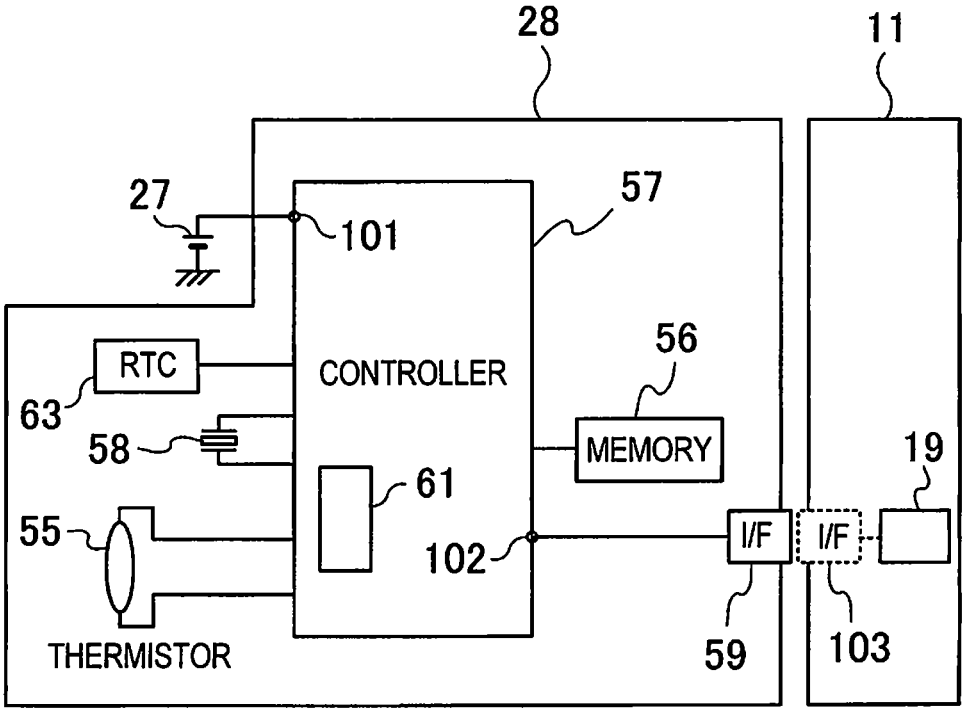
FIG. 4 is a block diagram of a control system used in the image forming apparatus.

As shown in FIG. 4, the circuit board 28 includes a memory 56 (recording medium) and a cartridge-side controller 57 (first controller).

The memory 56 records the result of measurement by a thermistor 55 in timing controlled by the cartridge-side controller 57. The memory 56 stores history of ambient temperatures of the yellow toner during transportation and storage of the toner cartridge 20Y. As the memory 56, for example, an EE-PROM (electrically erasable programmable read only memory) is used.

The cartridge-side controller 57 is a first controller. The cartridge-side controller 57 causes the thermistor 55 in the toner cartridge 20Y to measure the ambient temperature of the toner cartridge 20Y periodically. The cartridge-side controller 57 is supplied with power from the battery 27.

The cartridge-side controller 57 reads data from the memory 56 and writes data into the memory 56. As the cartridge-side controller 57, a CPU, a ROM and a RAM are used.

When the toner cartridge 20Y of FIG. 1 is loaded in the machine body 11, the main controller 19 reads ambient temperature information from the memory 56. The main controller 19 changes parameters as necessary based on the result of reading.

The configuration of the toner cartridges 20M, 20C and 20K is substantially the same as the configuration of the toner cartridge 20Y.

The print process unit 14 will now be described further.

Figure 2:
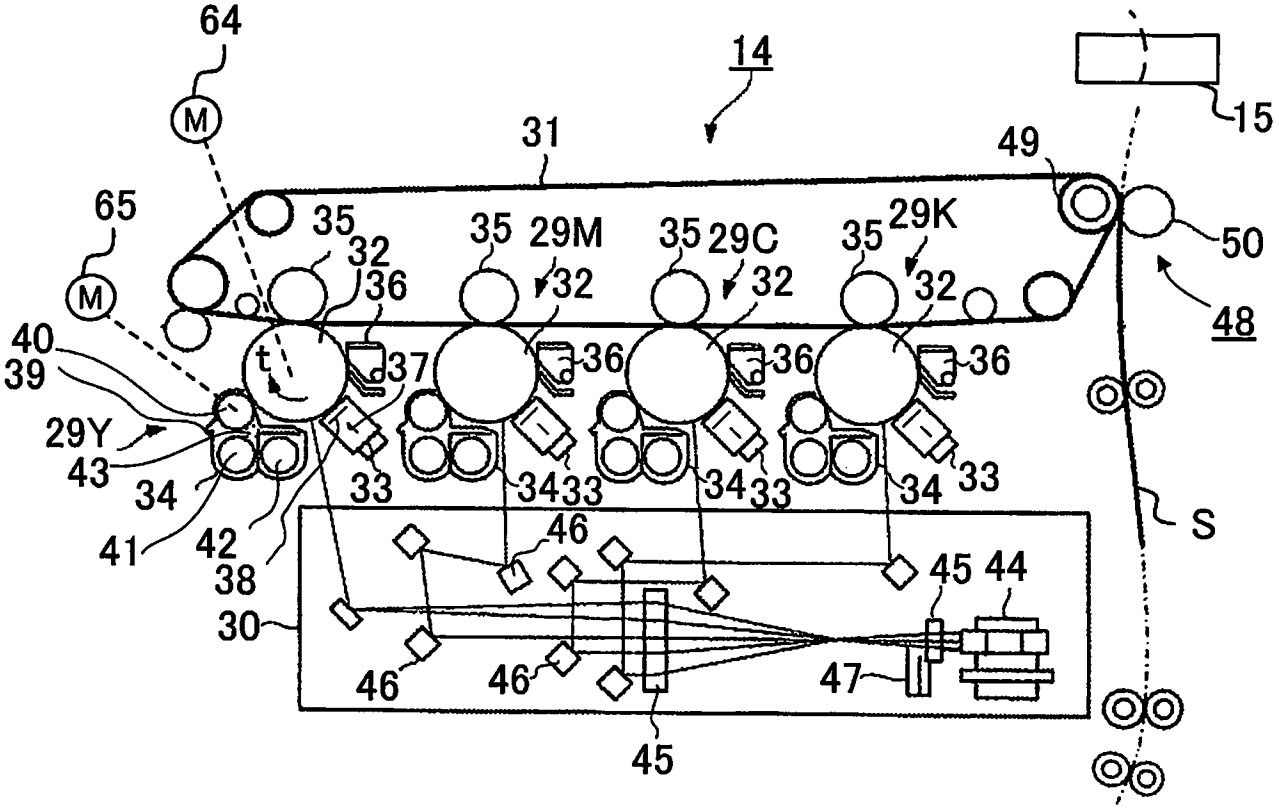
FIG. 2 is an enlarged view of a print process unit including, an image carrier, a latent image forming unit, a developing unit, and a fixing unit, used in the image forming apparatus.

FIG. 2 is an enlarged view of the print process unit 14. The reference numerals that are already described denote the same elements.

The print process unit 14 includes an image forming unit 29Y for yellow (Y), an image forming unit 29M for magenta (M), an image forming unit 29C for cyan (C), an image forming unit 29K for black (K), the laser exposure unit 30 (latent image forming unit), and a belt 31 (transfer target member).

The image forming unit 29Y has a photoconductive drum 32 (image carrier), the charger 33 (latent image forming unit), the developing unit 34, a primary transfer unit 35, and a cleaner 36.

The photoconductive drum 32 holds a latent image on the surface of the photoconductive drum 32.

The charger 33 generates corona discharge of several kV in a wire 37 and charges the surface of the photoconductive drum 32 to a negative potential. The charger 33 changes the charging amount on the surface of the photoconductive drum 32 by a grid bias voltage from a grid electrode 38 and thus stabilizes the corona discharge.

The developing unit 34 develops the electrostatic latent image on the photoconductive drum 32.

The developing unit 34 has a magnet roller 40 and mixers 41 and 42 in a container 39. The developing unit 34 fills the container 39 with a two-component developer. The developer is essentially made up of toner particles and magnetic carrier particles.

The container 39 has a supply port 43. The supply port 43 is connected to the toner cartridge 20Y directly or via a toner carrying path.

The container 39 has an aperture that faces the photoconductive drum 32. The mixers 41 and 42 stir and circulate the developer to the magnet roller 40. The magnet roller 40 supplies the developer from the aperture to the surface of the photoconductive drum 32.

The primary transfer unit 35 is a roller which transfers the toner image developed on the photoconductive drum 32 to the belt 31. A primary transfer bias voltage is applied to the primary transfer unit 35. The cleaner 36 cleans the surface of the photoconductive drum 32 after transfer.

The configuration of the image forming units 29M, 29C and 29K is substantially the same to the configuration of the image forming unit 29Y.

The laser exposure unit 30 irradiates a laser beam to each photoconductive drum 32 of the image forming units 29Y, 29M, 29C and 29K.

The laser exposure unit 30 includes a polygon mirror 44, a pair of lenses 45, plural mirrors 46, and four laser diodes 47.

Taking yellow as an example, the laser exposure unit 30 modulates the laser diode 47, based on image data of the yellow component. The pair of lenses 45 collimates the laser beam. The polygon mirror 44 and the mirrors 46 cause the laser beam to reciprocate in a main scanning direction on the photoconductive drum 32.

The light exposures of magenta, cyan and black are substantially the same as the example of yellow.

The belt 31 is an endless intermediate transfer belt. The belt 31 travels counterclockwise in FIG. 2.

In the example of the yellow toner, the photoconductive drum 32 rotates in direction t. A laser beam with a yellow wavelength lowers the charging potential at a part irradiated with the laser beam each photoconductive surface of the four photoconductive drums 32.

The laser exposure unit 30 and the charger 33 function as a latent image forming unit which forms an electrostatic latent image on the photoconductive drum 32.

The examples of the magenta toner, cyan toner and black toner are substantially the same as the example of the yellow toner.

The print process unit 14 also has a secondary transfer unit 48. The secondary transfer unit 48 nips a sheet (transfer target member) with the belt 31. The secondary transfer unit 48 has a backup roller 49 and a secondary transfer roller 50.

The secondary transfer unit 48 applies a secondary transfer bias voltage to the backup roller 49. The secondary transfer unit 48 secondary-transfers the color toner image onto the sheet.

Figure 3:
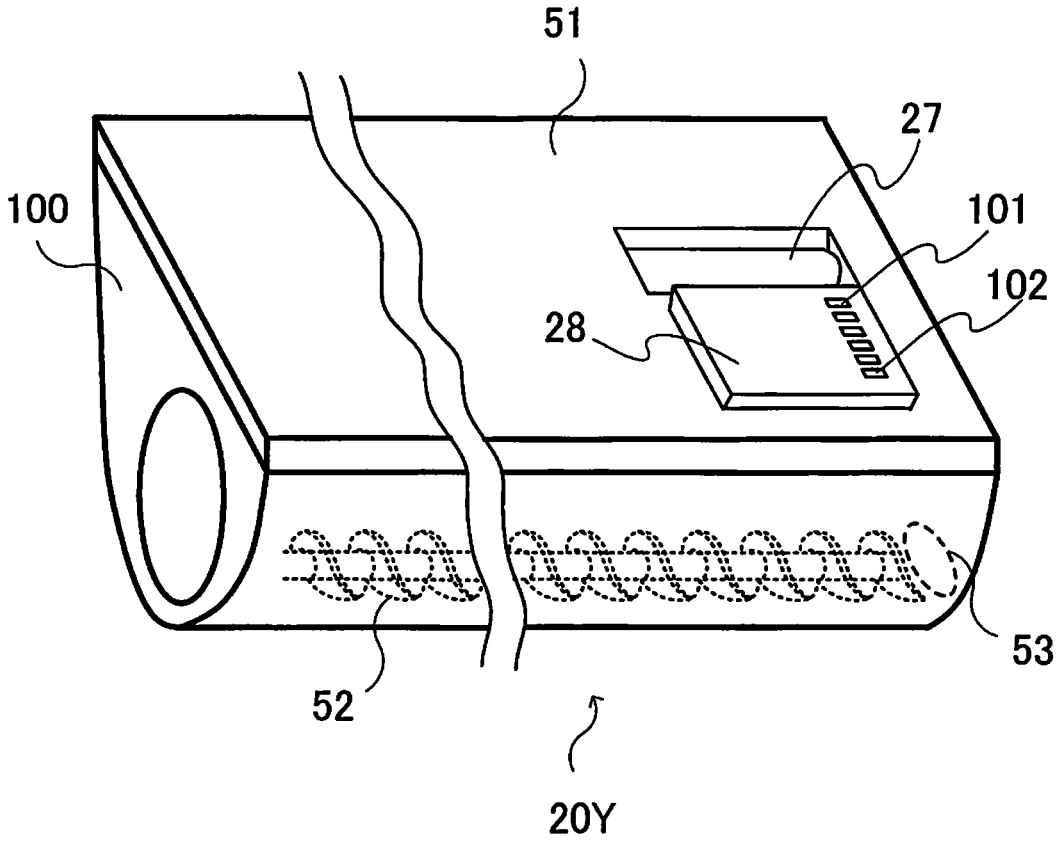
FIG. 3 is a perspective view of a toner cartridge used in the image forming apparatus.

FIG. 3 is a perspective view of the yellow toner cartridge 20Y. For example, a face 100 is on the front side of the MFP 10. The reference numerals that are already described denote the same elements.

The toner cartridge 20Y accommodates a supply of toner for the developing unit 34, in a container 51. The toner cartridge 20Y has an auger 52 in the container 51. The container 51 has a toner discharger port 53.

The toner cartridge 20Y is set in the space in the machine body 11. The toner cartridge 20Y receives, from a coupler 54, a driving force to turn the auger 52.

The auger 52 in the toner cartridge 20Y is turned. The auger 52 sends the toner to the discharger port 53. The toner cartridge 20Y supplies the toner to the developing unit 34.

In the toner cartridge 20Y, the battery 27 and the circuit board 28 are fixed on top of the container 51. Alternatively, in the toner cartridge 20Y, the battery 27 and the circuit board 28 may be fixed inside the container 51.

In this example, the circuit board 28 has terminal parts such as a power supply terminal 101 and an output terminal 102 on a board surface. The terminal parts communicate data between the main controller 19 on the side of the MFP 10 main body and the memory 56.

FIG. 4 is a block diagram of a control system focusing on a function of saving ambient temperatures of the toner cartridge 20Y. The reference numerals that are already described denote the same elements.

The circuit board 28 has the thermistor 55 (temperature sensor) which measures temperatures, and an oscillator 58 which outputs frequency signals.

The thermistor 55 measures the atmospheric temperature of the toner cartridge 20Y. As the thermistor 55 measures the temperature of air on the surface of the container 51 in a non-contact manner, the thermistor 55 approximates the atmospheric temperature of the toner cartridge 20Y.

The thermistor 55 includes a thermistor body with a resistance value varying according to changes in temperature, a pair of electrodes fixed to the thermistor body, and a temperature detecting circuit which applies a current or voltage to the pair of electrodes and then measures a resistance value, and detects the temperature corresponding to the resistance value.

The cartridge-side controller 57 writes the temperature information measured by the thermistor 55 into the memory 56.

FIG. 5 is a diagram showing an exemplary table in the memory 56. The temperature range 70 to 75° C. refers to a range of temperatures equal to or higher than 70° C. and lower than 75° C.

In a table 60, for example, data of a temperature zone 25 to 30° C., a counter name for the temperature zone, and a counter indicating the number of times the temperature detected by the thermistor 55 falls in the temperature zone, are stored in association with each other.

The temperature range 5 to 25° C. is a temperature range that has no influence on deterioration of the toner.

Each temperature range is of 5° C. The value 5° C. is decided to measure the degree of deterioration of the toner in relation to temperature and is decided by experiments, tests, simulations and the like.

For example, the detected temperature is now assumed to be 26° C. The cartridge-side controller 57 increments the counter value of a counter with a counter name "M25".

The oscillator 58 (FIG. 4) is, for example, a crystal oscillator. The cartridge-side controller 57 has a time measuring module 61. The time measuring module 61 measures a read cycle based on an output from the oscillator 58. The time measuring module 61 outputs a wakeup signal per read cycle.

In response to the wakeup signal from the time measuring module 61, the cartridge-side controller 57 periodically wakes up.

The cartridge-side controller 57 wakes up. The cartridge-side controller 57 causes the thermistor 55 to measure temperature. The cartridge-side controller 57 increments by one the counter value for the temperature zone to which the measured values belongs.

The memory 56 is non-volatile. The table 60 saves the temperature zones and counter values. The memory 56 saves information of ambient temperatures.

Moreover, the circuit board 28 has an interface unit 59, the power supply terminal 101 connected to the battery 27, and the output terminal 102 which outputs ambient temperature information. The interface unit 59 transmits and receives data to and from an interface unit 103 on the MFP 10 side.

In the toner cartridge 20Y, the battery 27 is fixed near the circuit board 28. The thermistor 55, the memory 56, the cartridge-side controller 57 and the oscillator 58 are supplied with power from the battery 27.

The circuit board 28 may generate a periodic timing signal using a real-time clock IC 63 (real-time clock output element) instead of generating a read cycle signal using the oscillator 58.

The cartridge-side controller 57 may also write the real-time time outputted from the real-time clock IC 62 in association with the temperature information, directly into the memory 56.

A method of recoding ambient temperatures includes: providing the battery 27, the memory 56, the thermistor 55, and the cartridge-side controller 57 in the toner cartridge 20Y; measuring periodically, by the thermistor 55, the ambient temperature; and incrementing, by the cartridge-side controller 57, the value of the memory counter corresponding to the temperature zone containing the measured value.

An image forming method according to this embodiment includes the following (a) to (e).

(a) Enclosing the toner in the toner cartridge 20Y.

(b) Starting to record periodically the ambient temperature of the toner cartridge 20Y. The term periodically refers to, for example, every five minutes.

(c) Reading out, by the main controller 19, the table 60 saved in the memory 56, after the toner cartridge 20Y is loaded in the MFP 10.

(d) Changing, by the main controller 19, parameters based on the temperature information that is read. The main controller 19 properly changes a parameter having a default set value and performs print according to the state of preservation of the toner.

(e) Forming, by the MFP 10, an image on a sheet using the changed parameter.

When the main controller 19 determines that the state of preservation of the toner is considerably poor, the main controller 19 does not perform print. The main controller 19 performs prints without having any influence of the toner on the MFP 10.

The configuration of the toner cartridges 20M, 20C and 20K is substantially the same as the configuration of the toner cartridge 20Y.

The manufacturer of the MFP 10 of the above configuration manufactures genuine products of the toner cartridges 20Y, 20M, 20C and 20K. Taking the yellow toner as an example, operation of the toner cartridge 20Y will be described.

A manufacturing apparatus mounts the battery 27, the memory 56, the thermistor 55, the cartridge-side controller 57, the oscillator 58 and the like on the circuit board 28. The manufacturing apparatus sets the circuit board 28 on the toner cartridge 20Y.

The manufacturing apparatus activates the cartridge-side controller 57. The manufacturing apparatus encloses the toner in the toner cartridge 20Y.

Figure 6:
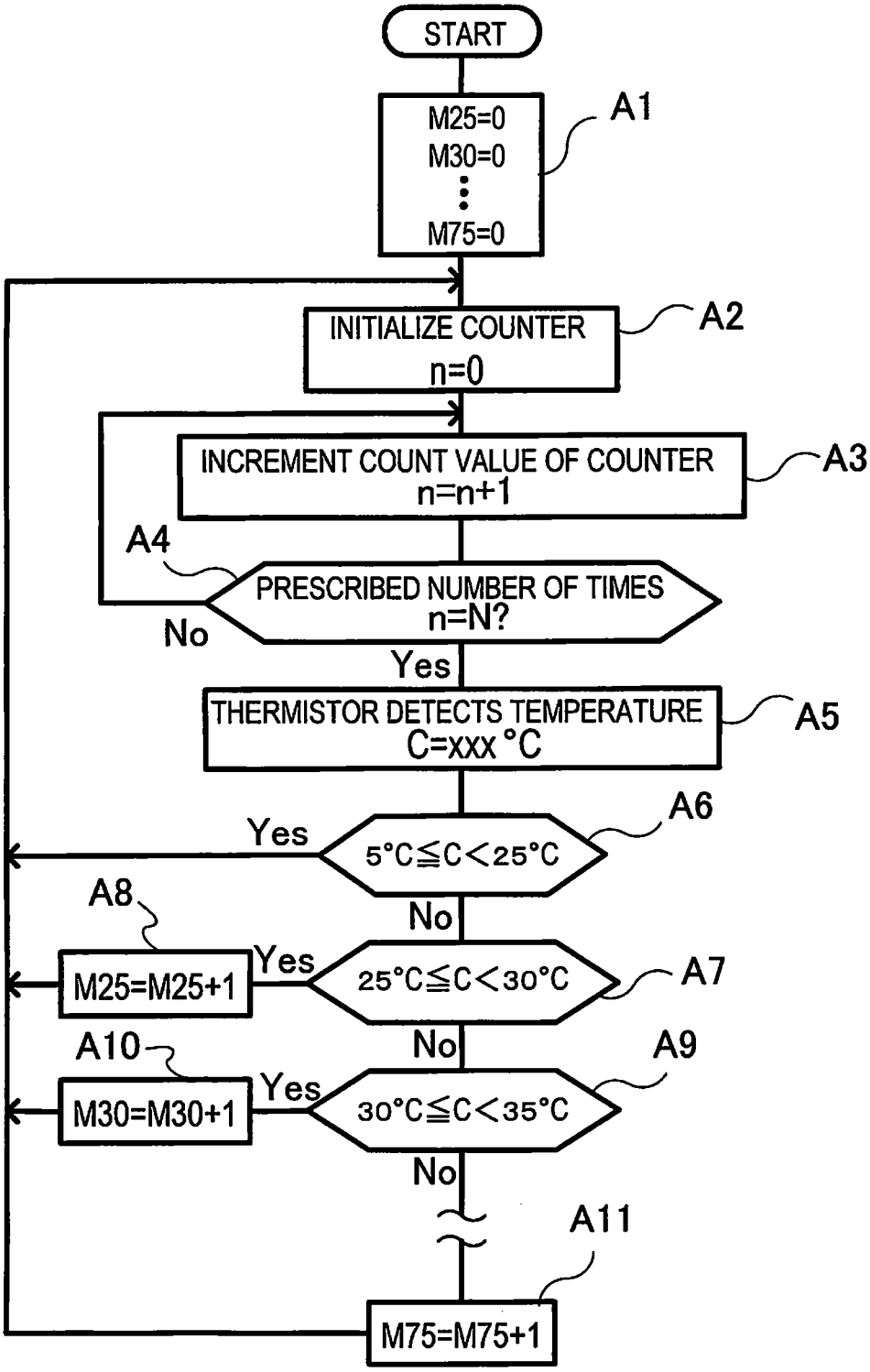
FIG. 6 is a flowchart illustrating operation of a first controller used in the image forming apparatus.

FIG. 6 is a flowchart illustrating operation of the cartridge-side controller 57 during the storage or transportation of the toner cartridge 20Y.

In ACT A1, when the cartridge-side controller 57 is started up, the various counters are in initial state. The counter value of any of the counters M25 to M75 is 0.

In ACT A2, the cartridge-side controller 57 initializes the read cycle using the time measuring module 61. In ACT A3, the time measuring module 61 increments the read cycle by one.

The manufacturing apparatus places the toner cartridges 20Y in the started-up state into a package box. The cartridge-side controller 57 starts making the thermistor 55 detect temperatures before shipping.

In ACT A4, the cartridge-side controller 57 determines whether the cycle counter reaches a prescribed number of times N. The prescribed number of times N refers to the number of times shown by the cycle counter equivalent to time intervals of wakeup. For example, the cycle counter expires in 5 minutes.

In ACT A4, during the cycle counter does not expire, the cartridge-side controller 57 takes No-route and executes processing of ACT A3.

In ACT A4, if the cycle counter expires, the cartridge-side controller 57 takes Yes-route and causes the thermistor 55 to detect the temperature in ACT A5.

In ACT A5, the cartridge-side controller 57 acquires a measured value C expressed by a voltage from the thermistor 55.

In ACT A6, the cartridge-side controller 57 determines whether the measured value C falls within the range 5 to 25° C.

If the result of the determination is affirmative, the cartridge-side controller 57 takes Yes-route and executes processing of ACT A2 without recording data in the table 60. The cartridge-side controller 57 sleeps until the next measuring time comes.

If the result of the determination is negative, the cartridge-side controller 57 takes No-route and determines whether the measured value C is within the range 25 to 30° C., in ACT A7.

In the example of the flowchart, the measured value C is now assumed to be 26° C.

In ACT A7, if the result of the determination is affirmative, the cartridge-side controller 57 takes Yes-route and increments the counter value in the memory area corresponding to the counter name "M25" in the table 60, in ACT A8. After that, the cartridge-side controller 57 executes processing of ACT A2.

Meanwhile, in ACT A5, if the measured value C is not in the target temperature zones of ACT A6 and ACT A7, the cartridge-side controller 57 takes No-route from ACT A6 and No-route from ACT A7. The cartridge-side controller 57 determines whether the measured value C is within the range 30 to 35° C., in ACT A9.

If the result of the determination is affirmative, the cartridge-side controller 57 takes Yes-route. The cartridge-side controller 57 increments the counter name "M30" in ACT A10 and executes processing of ACT A2.

If the result of the determination in ACT A9 is negative, the cartridge-side controller 57 takes No-route and determines whether the measured value C is in the next temperature zone.

Substantially similarly to processing of ACT A6 to ACT A10, the cartridge-side controller 57 uses branching processing to determine whether the measured value C is in the subsequent temperature zones.

In ACT A11, the cartridge-side controller 57 only determines whether the measured value C is equal to or higher than 75° C., or not.

If the result of the determination is affirmative, the cartridge-side controller 57 increments the counter value of the counter name "M75 (over 75)" and returns to processing of ACT A2.

In this manner, the toner cartridge 20Y continues recording ambient temperatures around the toner cartridge 20Y during the storage and transportation of the toner cartridge 20Y. The toner cartridge 20Y continues this recording until the toner cartridge 20Y is loaded in the MFP 10.

Operation during the storage and transportation of the toner cartridges 20M, 20C and 20K is substantially the same as the example of FIG. 6.

Hereinafter, operation after loading the toner cartridge 20Y in the MFP 10 will be described.

A person installs the toner cartridge 20Y in the MFP 10. The terminal parts on the circuit board 28 are electrically connected to the main controller 19 on the MFP 10 side.

The main controller 19 loads table data saved in the memory 56 or the like loaded in the toner cartridge 20Y, to the MFP 10 side.

The main controller 19 generates in advance the parameter change table 62 that is different from the table 60.

FIG. 7 is a diagram showing an example of the parameter change table 62. Table entries in the parameter change table 62 include storage temperature (temperature zone), counter value (counter threshold of each temperature zone), expiry date, stirring time, and parameter value groups for image formation.

The main controller 19 spreads the counter value of each temperature zone into the RAM 24 from the table 60. The main controller 19 compares each counter value with the counter threshold in the parameter change table 62.

The main controller 19 searches the temperature zones and extracts one or plural temperature zones having a greater counter value than the counter threshold.

The main controller 19 sets parameters for the laser exposure unit 30, the charger 33, the developing unit 34 and the primary transfer unit 35 based on the parameter value group that is selected and allocated.

The main controller 19 changes the parameters for image formation from various default parameters with reference to the parameter change table 62.

For example, the main controller 19 detects that the counter value of the temperature zone of 25 to 30° C. is greater than a threshold 51840.

The main controller 19 changes the setting of the toner expiry date within the detected toner cartridge 20Y to 2.5 years.

The main controller 19 forces the developing unit 34 to stir the toner in the detected toner cartridge 20Y. The main controller 19 sets the driving time of the mixers 41 and 42, for example, to 10 seconds, and thus extends the driving time.

For example, when the storage temperature zone of to 50° C. exceeds the counter value 1008, the main controller 19 issues a command to the developing unit 34. The mixers 41 and 42 stir the developer for a stirring time of 120 seconds. As the stirring time is made longer, the toner that is hardened by the storage at high temperatures melts.

Alternatively, when the storage temperature zone of 60 to 65° C. exceeds a counter value 36, the main controller 19 issues a command to the operation panel 18 or the like. The operation panel 18 displays a message that the toner is unusable because of poor storage of the toner.

The main controller 19 also reads image forming conditions from the parameter change table 62. The main controller 19 allocates and sets the parameter value group of setting 1 to the detected toner cartridge 20Y.

In the parameter change table 62, numeric values for changing developing conditions, transfer conditions and fixing conditions, of the image forming conditions, are stored as parameters in advance.

The developing conditions refer to output power of laser beam, laser beam irradiating time, developing bias, toner stirring time, rotation speed of a drum motor 64 of the photoconductive drum 32, and rotation speed of a developing motor 65 of the magnet roller 40.

The transfer conditions refer to primary transfer bias and secondary transfer bias. The fixing conditions refer to fixing temperature and fixing time.

The main controller 19 causes the operation panel 18 to display expiry date information thus acquired.

The main controller 19 may extend the expiry date when the counter value is smaller than the threshold. The main controller 19 may shorten the expiry date when the counter value is greater than the threshold.

The toner may deteriorate because of heat and humidity. The MFP 10 can perform image formation based on information about what kind of environment the toner cartridge 20Y is preserved in.

For example, the presence of many counter values corresponding to temperature zones exceeding 60° C. indicates that the state of preservation of the toner is poor during storage and during transportation. Information that the toner is unusable is displayed on the operation panel 18 to notify the user.

Meanwhile, even if the toner cartridge 20Y is preserved in a high-temperature place, there may be little deterioration of the toner and hence no problem with the use of the toner.

When the toner cartridge 20Y is preserved for long in an environment with temperatures 5 to 25° C., the expiry date can be extended further.

The setting of the toner cartridges 20M, 20C and 20K is substantially the same as the example of FIG. 6.

Figure 8:
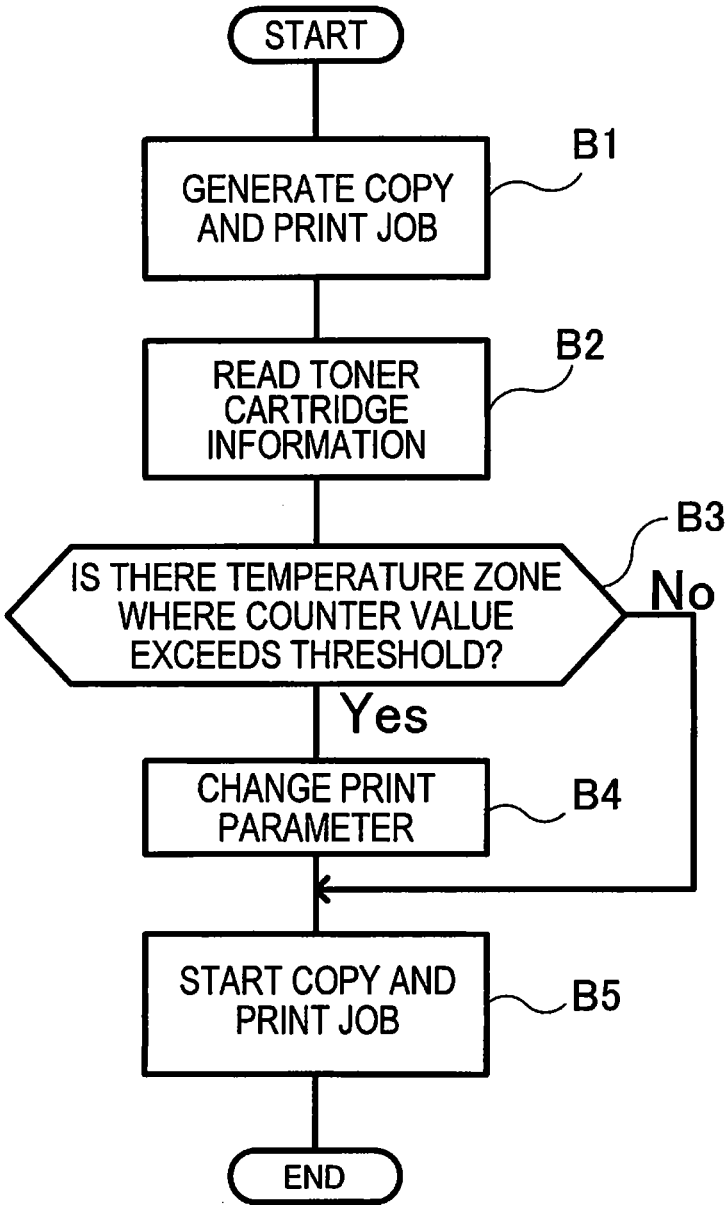
FIG. 8 is a flowchart illustrating operation of a print process of the image forming apparatus.

FIG. 8 shows an example of operation of the main controller 19 in which the main controller 19 executes a print process using data that is saved in the toner cartridges 20Y to 20K after the toner cartridges 20Y to 20K are loaded in the machine body 11.

FIG. 8 is a flowchart illustrating the operation of the print process in the image forming apparatus according to the embodiment.

In ACT B1, a copy or print job occurs.

In ACT B2, the main controller 19 reads table data saved in the memory 56 from the toner cartridges 20Y, 20M, 20C and 20K.

In ACT B3, the main controller 19 determines whether there is a temperature zone having a counter value exceeding the threshold, among the respective temperature zones.

If such a temperature zone exists in ACT B3, the main controller 19 then takes Yes-route and in ACT B4, the main controller 19 executes display of the expiry date, notification of the stirring time to the developing unit 34, and change of the parameter value.

In ACT B5, the main controller 19 prints and outputs a sheet under the image forming conditions after the change.

If plural such temperature zones exist in ACT B3, the main controller 19, by way of example, selects a temperature zone with high priority ranking, of the plural temperature zones, and executes processing of ACT B4.

If no such temperature zones exist in ACT B3, the main controller 19 takes No-route and prints in ACT B5 without changing any setting.

Meanwhile, if a counter value exists within temperature zones of 60° C. or higher in ACT B3, the main controller 19 causes the operation panel 18 to display that the toner of the toner cartridge 20Y or the like is unusable.

In the example of FIG. 7, when the counter value corresponding to the storage temperature 25 to 30° C. exceeds 51840, the main controller 19 changes the parameter value as of that time, using a parameter defined by the "setting 1".

In this example, the developing bias, primary transfer bias, secondary transfer bias and fixing temperature are taken as examples. However, the main controller 19 may also change the output power of laser beams, the laser beam emitting time, or the fixing time or the like.

The main controller 19 is desirable to provide appropriate parameters according to the toner properties changed by the state of preservation of the toner.

Even after the toner cartridges 20Y, 20M, 20C and 20K are loaded in the MFP 10, the cartridge-side controller may read the ambient temperatures of the toner cartridges 20Y, 20M, 20C and 20K and save the measured values in the memory 56.

After the loading, the cartridge-side controller 57 may acquire the atmospheric temperatures of the toner cartridges 20Y, 20M, 20C and 20K irrespective of whether power is on or off on the MFP 10 side.

Alternatively, the cartridge-side controller 57 may separately save various parameters after the toner cartridges 20Y, 20M, 20C and 20K are loaded in the MFP 10, and various parameters before the loading of the toner cartridges.

After the loading, the cartridge-side controller 57 may periodically acquire the temperature of the toner cartridges and further change the various parameters from the various parameters before the loading.

In this example, the cartridge-side controller 57 counts "how many times the measured temperature falls within the temperature zone" for each temperature zone and saves the counter value, as shown in the flowchart of FIG. 6. The MFP 10 may periodically write the time itself from the real-time clock IC 63 and the temperature itself into the memory 56 and may use that data.

In this case, the cartridge-side controller 57 periodically reads the voltage level of the thermistor 55 and saves the time period during which a predetermined temperature is exceeded, in the memory 56.

In displaying the expiry date, the main controller 19 may compare the manufacturing date of each toner saved in advance in the memory 56 in the toner cartridges 20Y, 20M, 20C and 20K, with real-time time data outputted from another real-time clock IC installed in the MFP 10, and thus decide the expiry date.

The main controller 19 causes the operation panel 18 or the like to display that the expiration date is already expired, when the read-out time exceeds the earlier one of the expiry date acquired from the real-time clock and the expiry date shown in FIG. 7. The user can be prompted to replace the toner and the print by the MFP 10 can be stopped.

Thus, optimum images can constantly be formed according to the state of preservation of the toner.

Moreover, the toner expiry date can be changed to restrain influence of the deteriorated toner on the image forming apparatus. On the other hand, when the state of preservation is good, the expiry date can be extended.

In the related arts, a method is known in which, in a warehouse during storage or at a base during transportation, a writing device writes ambient temperatures in the warehouse or vehicle into a recording medium. A method is also known in which a temperature detecting sticker is pasted to a toner cartridge and when the toner cartridge is preserved, the sticker detects that the toner is placed under high temperatures.

Information recorded by the former method is simply the ambient temperature at a certain place where temperature is controlled in advance, such as at the warehouse or during transportation. Ambient temperatures in places where temperature is not controlled cannot be acquired. With the former method, an effort is needed to write ambient temperatures in the warehouse and during transportation into each toner cartridge.

In the latter method, a temperature detecting sticker with irreversible change in color is attached to the toner cartridge and the state of preservation of the toner cartridge is learned from the change in the color of the sticker.

With the latter method, the user must discriminate the state of the toner based on the color of sticker. The latter method merely mainly lets the user recognize that the toner cartridge is unusable when the color is changed.

The latter method is not suitable for the image forming apparatus to perform fine control of parameters for image formation according to the state of preservation of the toner.

Moreover, in the related art, an image forming apparatus is known in which a thermistor in the image forming apparatus measures temperature when a main power supply of the image forming apparatus turns on after a toner cartridge is loaded.

However, the image forming apparatus according to the related art has no means for measuring atmospheric temperatures in the machine body when the main power supply is off. For example, when the machine body with the power supply being off and with the toner cartridge loaded therein is placed in a high-temperature environment, the toner inside deteriorates. The image forming apparatus according to the related art cannot work for this deterioration of the toner.

By contrast, the MFP 10 can grasp the atmospheric temperatures of the machine body 11 when the main power supply is off. Resultant deterioration of the toner can be avoided.

With the MFP 10, since the cartridge-side controller 57 writes the state of preservation into the memory 56, it can be detected that the toner is under high temperatures. Appropriate image formation can be performed according to the state of the toner.

MODIFICATION

Non-genuine products or recycled products of the toner cartridges may be loaded in the MFP 10, instead of genuine products of the toner cartridges 20Y, 20M, 20C and 20K.

With toner cartridges manufactured by a third party that is different from a genuine manufacturer, temperature zones and counter values cannot even be written in a recording medium equivalent to the memory 56.

When the toner cartridges are loaded in the MFP 10, the main controller 19 cannot read parameters normally.

When it is detected that parameters cannot be read, the toner cartridges that are different from genuine products are detected as loaded in the MFP 10. The main controller 19 causes the operation panel 18 to display that genuine products should be used. The main controller 19 sets the parameters to secure values.

The MFP 10 may also be equipped with a toner cartridge authentication function. The MFP 10 holds an authentication program in advance in the ROM 23. Significant authentication data such as specific information that can be recognized by the authentication program are stored in advance in the memory 56.

When non-genuine products or recycled products of the toner cartridges are loaded in the MFP 10, the main controller 19 transmits an authentication request to the cartridge-side controller 57. When the main controller 19 does not receive an authentication response, the main controller 19 causes the operation panel 18 to display that genuine products should be used. Thus, image quality can be maintained.

When genuine products of the toner cartridges are loaded in the MFP 10, the main controller 19 receives significant authentication data from the cartridge-side controller 57. The main controller 19 determines that authentication is successful. The main controller 19 reads temperature zone information and counter values in the memory 56.

OTHERS

The contents of parameters can be changed in various ways depending on the developing conditions, transfer conditions and fixing conditions. Of the parameters of the developing conditions, numeric values to be selected can be changed as needed.

The developing bias, the charging bias, the laser beam power, the linear velocity of the photoconductive drum 32 and the linear velocity of the magnet roller 40 decide the developing conditions.

The developing bias, the charging bias and the laser beam power decide potential developing capability of the developing unit 34. The linear velocity of the photoconductive drum 32 and the linear velocity of the magnet roller 40 enhance contactability between the magnetic brush and the photoconductive surface.

The MFP 10 may also record the manufacturing time of the toner cartridge, which is necessary for calculating the expiry date, in units other than the recording medium. For example, the MFP 10 can also show the manufacturing time by hardware.

The controller may further store information of the region where the MFP 10 is introduced. Based on the information of the region, the controller selects one of plural pieces of temperature information and calculates the expiry date corresponding to the selected temperature information.

After the MFP 10 is introduced, the controller can also detect that installation conditions are changed because of the migration, and can read the table again.

The shape and structure of the toner cartridge 20Y shown in FIG. 3 is simply an example. The shape and structure, and the positions where the battery and circuit board are loaded, can be changed in various ways. The predominance of the image forming apparatus according to the embodiment over an embodiment with a changed shape and structure will not be undermined.

While the thermistor 55 is used as a temperature sensor, a thermocouple, a platinum resistance thermometer, IC temperature sensor, a thermopile, an NC sensor or the like can be used as a temperature sensor.

An RFID, IC tag or the like may be used as a recording medium to record temperature information.

In the embodiment, the connection between the machine body 11 and the toner cartridge 20Y and the like is not limited to wired connection, but a transmitter-receiver for radio signals may be provided in each of the machine body 11 and the toner cartridge 20Y and the like. As signals are transmitted and received by short-distance wireless transmission and reception, similar operation to the example in the embodiment can be carried out.

When a measured value falls in the temperature zones of 0 to 25° C., the MFP 10 does not record data. However, temperature zones for which data is not recorded can be changed in various ways.

The image forming apparatus according to the embodiment may control temperature information in Fahrenheit as well as in Celsius.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the spirit of the inventions. The accompanying claims and their equivalents are intended to cover such forms or modifications as would fall within the scope and spirits of the inventions.

What is claimed is:

1. An image forming apparatus comprising:

an image carrier;

a latent image forming unit configured to form an electrostatic latent image on the image carrier;

a developing unit configured to develop the electrostatic latent image with a two-component developer containing toner particles and carrier particles;

a fixing unit configured to fix, on a sheet, a toner image formed on the image carrier by the developing unit;

a toner cartridge configured to hold and supply toner for the developing unit;

a battery provided on the toner cartridge;

a temperature sensor provided in the toner cartridge and powered by the battery;

a first controller provided on the toner cartridge and configured to cause the temperature sensor to measure an ambient temperature periodically after enclosing the toner in the toner cartridge and be powered by the battery;

a recording medium provided on the toner cartridge and configured to record information including a result of the periodic measurements by the temperature sensor; and a second controller configured to control execution of an image forming process, read out information recorded in the recording medium after the toner cartridge is loaded into the image forming apparatus, and change at least one operating condition of at least one of the latent image forming unit, the developing unit, and the fixing unit, based on the information.

2. The apparatus of claim 1, wherein the recording medium holds counter values in respective counters of plural temperature zones, the counter value indicating a number of times a temperature measured by the temperature sensor is within each temperature zone, and the second controller reads out the counter values from the recording medium and changes at least one of the operating conditions according to the counter values.

3. The apparatus of claim 2, wherein the at least one of the operating conditions changed by the second controller is an expiry date information of the supply of toner.

4. The apparatus of claim 3, wherein the second controller causes an operation panel to display the expiry date information.

5. The apparatus of claim 1, wherein the at least one of the operating conditions changed by the second controller includes one or more of an intensity of a laser beam from a laser exposure unit which forms the electrostatic latent image, a irradiating time of the laser beam, a charging bias applied to the charger, a developing bias applied to the developing unit, and a fixing temperature and a fixing time of the fixing unit.

6. The apparatus of claim 2, further comprising an oscillator configured to output a frequency signal, wherein the first controller measures a read cycle based on an output from the oscillator and a processor timer, and causes the temperature sensor to measure the ambient temperature when the read cycle is reached.

7. The apparatus of claim 1, further comprising a transfer target member configured to transfer thereon the toner image formed on the image carrier by the developing unit, wherein the at least one of the operating conditions changed by the second controller includes changing a transfer bias applied to the transfer target member.

8. The apparatus of claim 1, wherein the developing unit comprises a mixer which stirs the two-component developer, and the at least one of the operating conditions changed by the second controller includes changing a stirring time of the two-component developer by the mixer.

9. The apparatus of claim 1, wherein the first controller continues causing the temperature sensor to periodically measure the ambient temperature even after the toner cartridge is loaded in the body.

10. The apparatus of claim 9, wherein the second controller controls execution of the image forming process using:

the at least one operation condition set before the toner cartridge is loaded into the image forming apparatus, if the image forming process is executed before the toner cartridge is loaded into the image forming apparatus, and the at least one operation condition that is changed after the toner cartridge is loaded into the image forming apparatus, if the image forming process is executed after the toner cartridge is loaded into the image forming apparatus.

11. The apparatus of claim 1, further comprising a real-time clock output element configured to output real-time information, wherein the first controller records temperature information measured by the temperature sensor and time information from the real-time clock output element, in association with each other, into the recording medium, and the second controller changes the at least one of the operating conditions based on the temperature information and the time information.

12. The apparatus of claim 1, further comprising a storage unit configured to hold plural parameter value groups, each parameter value group containing at least an intensity of a laser beam from a laser exposure unit which forms the electrostatic latent image, a irradiating time of the laser beam, a charging bias applied to the charger, a developing bias applied to the developing unit, and a fixing temperature and a fixing time of the fixing unit, wherein the second controller changes the at least one of the operating conditions in accordance with one of the plural parameter value groups.

13. The apparatus of claim 1, wherein the recording medium has authentication data stored therein, and when the second controller authenticates the toner cartridge according to the authentication data, the second controller reads the information recorded in the recording medium.

14. A toner cartridge comprising:

a container including a discharge port through which toner is supplied to an image forming apparatus, and a chamber for a supply of toner communicating with the discharge port;

an auger provided in the chamber and configured to carry the supply of toner to the discharge port;

a battery mounted to the container;

a temperature sensor driven by the battery;

a first controller configured to cause the temperature sensor to measure an ambient temperature of the toner cartridge periodically after enclosing the toner in the toner cartridge and be powered by the battery;

a recording medium provided on the toner cartridge and configured to record information including a result of the periodic measurements by the temperature sensor; and a circuit board including a power supply terminal which supplies power from the battery to the first controller, and an output terminal which outputs the recorded information to the image forming apparatus after the toner cartridge is loaded in the image forming apparatus, the recorded information usable in the image forming apparatus to change at least one image forming condition.

15. The toner cartridge of claim 14, wherein the recording medium holds counter values in respective counters of plural temperature zones, the counter value indicating a number of times a temperature measured by the temperature sensor is within each temperature zone, and the first controller outputs the counter values to the output terminal.

16. The toner cartridge of claim 14, wherein the first controller continues causing the temperature sensor to measure the ambient temperature periodically even after the toner cartridge is loaded in the image forming apparatus.

17. An image forming method comprising:

providing a supply of toner to be supplied to an image forming apparatus, a battery, a temperature sensor, a recording medium, and a first controller which causes the temperature sensor to periodically measure an ambient temperature, in a toner cartridge;

after enclosing the toner in the toner cartridge, recording into the recording medium information including the periodic measurements by the temperature sensor;

reading out, with a second controller in the image forming apparatus, the information recorded in the recording medium after the toner cartridge is loaded in the image forming apparatus;

changing at least one operating condition for image formation based on the information; and executing an image forming process using the operating condition after the change.

18. The method of claim 17, further comprising:

recording counter values in respective counters of the plural temperature zones, the counter value indicating a number of times a temperature measured by the temperature sensor is within each temperature zone.

19. The method of claim 17, further comprising:

measuring a read cycle based on a frequency signal outputted from an oscillator and a processor timer, and measuring the ambient temperature when the read cycle is reached.

20. The method of claim 17, further comprising:

recording temperature information measured by the temperature sensor and time information from a real-time clock output element in association with each other in the recording medium.

* * * * *